United States Patent [19]

Gimple et al.

[11] 3,940,061

[45] Feb. 24, 1976

[54] ELECTROSTATIC SPRAY GUN FOR POWDER COATING MATERIAL

[75] Inventors: James J. Gimple; Charles T. Lasley; Rogers. Daniel M., all of Toledo, Ohio

[73] Assignee: Champion Spark Plug Company, Toledo, Ohio

[22] Filed: Sept. 16, 1974

[21] Appl. No.: 506,200

[52] U.S. Cl. ..... 239/15; 239/105; 239/291

[51] Int. Cl.[2] ..... B05B 5/02; B05B 1/28

[58] Field of Search ..... 239/3, 15, 290, 104, 291, 239/105; 317/3, 262 R

[56] References Cited

UNITED STATES PATENTS

| | | | |
|---|---|---|---|
| 2,302,289 | 11/1942 | Bramston-Cook | 317/3 X |
| 2,504,117 | 4/1950 | Downs | 239/291 X |
| 2,743,963 | 5/1956 | Peeps | 239/290 |
| 3,061,198 | 10/1962 | Kerr et al. | 239/15 X |
| 3,179,849 | 4/1965 | Schweriner | 317/3 UX |
| 3,292,860 | 12/1966 | Williams et al. | 239/3 X |
| 3,332,623 | 7/1967 | Gallant | 239/105 |
| 3,473,735 | 10/1969 | Drum | 239/3 X |
| 3,630,441 | 12/1971 | Felici et al. | 239/3 X |
| 3,659,151 | 4/1972 | Fabre | 239/3 X |

FOREIGN PATENTS OR APPLICATIONS

| | | | |
|---|---|---|---|
| 339,943 | 9/1959 | Switzerland | 239/105 |
| 1,325,474 | 3/1963 | France | 239/290 |
| 1,524,334 | 4/1968 | France | 239/290 |

*Primary Examiner*—Robert S. Ward, Jr.
*Attorney, Agent, or Firm*—Allen Owen

[57] ABSTRACT

The invention relates to an electrostatic spray gun for the deposition of powdered coating material characterized by an improved deposition efficiency and provided with a multi-stage, trigger operated control that permits spraying at a plurality of conditions that may be preselected by the operator. An axially disposed needle charging electrode is used and an axial air flow passage surrounds the same to reduce any troublesome accumulation of powder on the needle under all spraying conditions.

5 Claims, 5 Drawing Figures

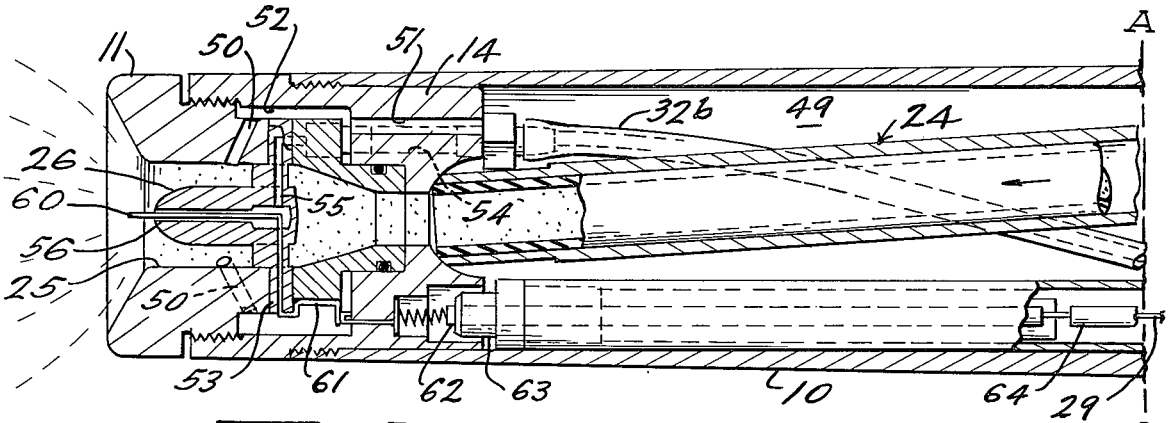
FIG-1-
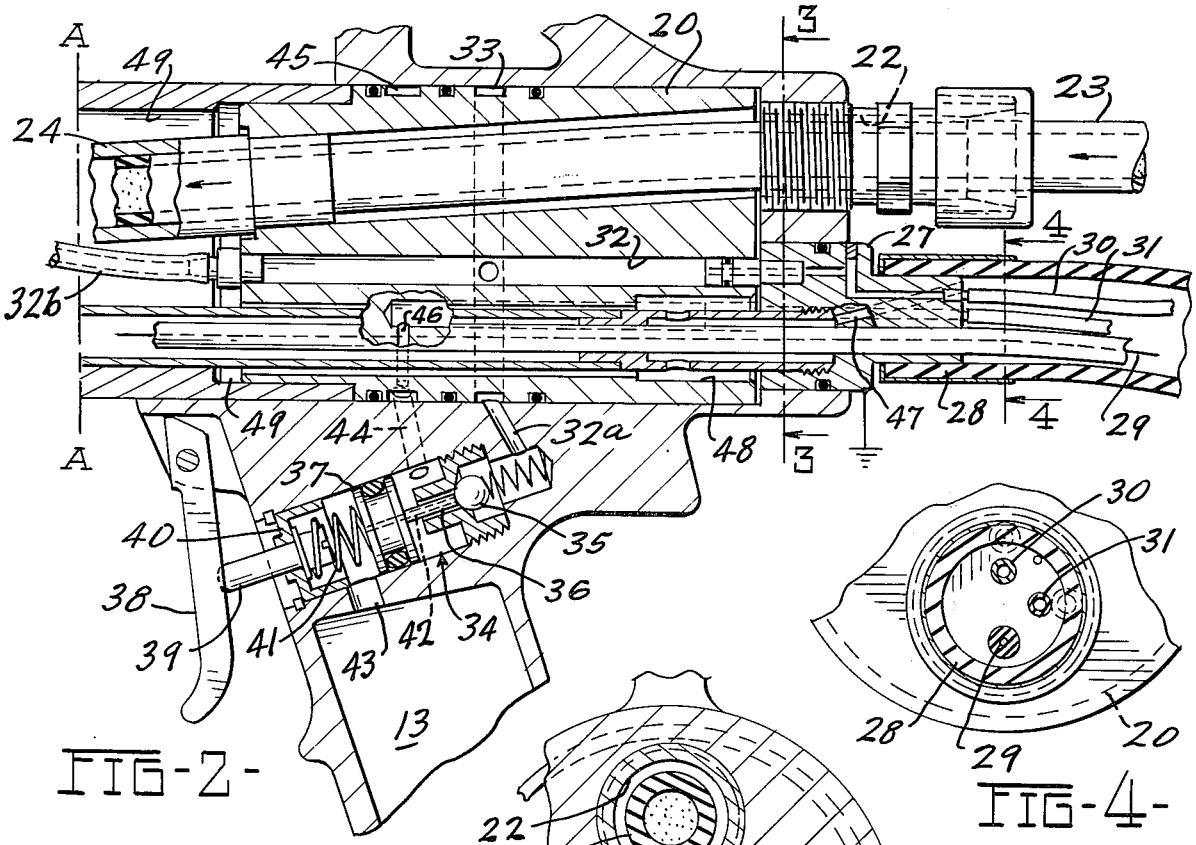
FIG-2-
FIG-4-
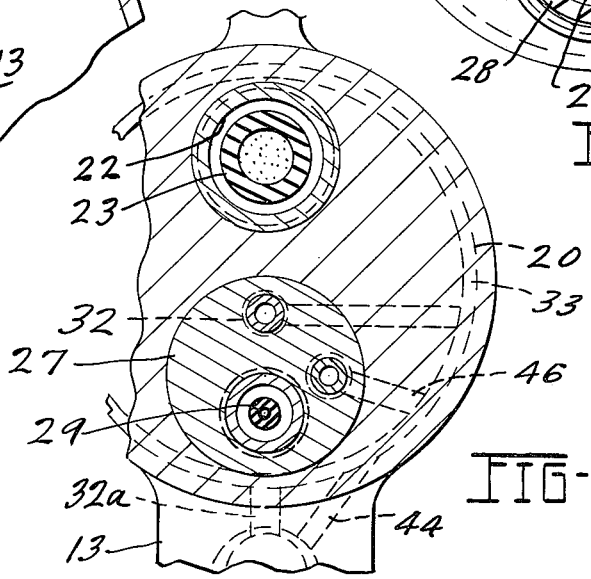
FIG-3-

ELECTROSTATIC SPRAY GUN FOR POWDER COATING MATERIAL

BACKGROUND OF THE INVENTION

Spray guns for the electrostatic deposition of powdered coating materials generally comprise an insulating barrel through which an air-borne stream of the solid particles flows to be charged electrostatically either within a spray cap carried by the barrel or upon issuance therefrom. Various forms of charging electrodes have been proposed and almost without exception have been less efficient than necessary and have frequently been subject to the accumulation of powder particles where the electrode protrudes into the powder stream at the discharge end of the gun. If the electrodes are outside the powder stream or spray pattern the charge on each of the spray particles is low and the charging process is inefficient. If the electrode is disposed within the spray pattern there is a tendency to accumulate powder on the electrode which then blows off in globs and causes spots or other defects in the coating. This is especially true if the electrode is of a convoluted or complex shape. The present invention has as one of its features the provision of a needle electrode within the spray pattern which is constantly washed and kept clean by a surrounding air stream of such low volume that it will not disturb the spray pattern. The velocity of the shielding or washing air stream is kept high for best effectiveness, as the air shield must persist for the full length of the needle.

Electrostatic powder spray guns are frequently used to coat relatively complex parts which include not only large flat surfaces but also interior corner areas and separated elements such as ribs or bars. It is well known that the large flat surfaces will accept an electrostatically charged powder at a high rate so that the air flow through the powder pump and the resulting powder flow through the gun may be high. If an air stream is used to expand or otherwise shape the powder stream by imparting, for example, a whirling motion thereto then the volume of air in this vortex forming stream should be high when the powder carrying air flow is high. Conversely, if the electrostatic spray gun is being used to coat a portion of the work that requires only a low powder flow such as an interior corner or an isolated bar or rib then the powder flow should be at a lower volume and the volume of the vortex forming air stream may be correspondingly reduced. Thus the operator has certain choices of spraying conditions that he would like to be able to make prior to the start of a spraying operation.

BRIEF DESCRIPTION OF THE INVENTION

The invention provides an electrostatic powder spray gun and associated control system in which coating powder is taken from a fluidized supply at different rates. For example, when a low powder flow rate is desired the operator sets a regulator valve on the panel which when actuated by a first parallel air circuit gives the desired low rate. This first "low rate operation" is then caused to function when a first pilot valve is closed and bringing about a low powder flow and a low dispersing air flow. Hereafter such dispersing or pattern shaping air will be referred to as "vortex air" since in the spray gun shown the powder is discharged into an air vortex which expands the spray pattern as the vortex air flow increases and permits the discharge of a more concentrated pattern when the vortex air flow decreases. The operator also sets a second regulator valve on the panel which, when actuated by a second parallel air circuit, gives a desired higher rate. When a second pilot valve operates, pilot valves admitting higher powder flow and higher vortex air pressure are operated responsively. This establishes high flow conditions under which a greater quantity of powder is fed to the gun and dispersed by the greater flow of vortex air into a larger pattern for coating larger portions of the work such as flat wall areas. Having analyzed a particular workpiece for its area requiring "low flow" and its other areas requiring "high flow" the operator can move quickly from one to the other as he sprays repetitively a succession of similar parts conveyed in front of him through a spray booth. Each change from high flow to low flow and vice versa is under the influence of the gun trigger and causes the proper change in feed pressure and vortex air pressure to the gun. A regulator valve in the gun and controlled by the gun trigger is used to operate the pilot valves back at the panel which control the regulators that were preset by the operator.

In the past there has been no opportunity to correlate the rate of powder feed and the pattern shaping or dispersing air pressure without making an individual panel adjustment each time a change was made.

The spray gun of the present invention is provided with a nozzle assembly which is constructed entirely of insulating material except for an axially disposed charging electrode. A voltage of many kilovolts is imposed on the charging electrode and the work is usually grounded so that a very intense electrostatic field is set up in the region of the charging electrode. The field intensity is best maintained when the electrode is essentially bare and which thus makes it highly desirable to prevent the accumulation of powder on the electrode which would act to insulate it, thus reducing its effectiveness. The accumulation of powder on the electrode also results in the further disadvantage in that the accumulated powder blows away from the electrode in globs and tends to deposit on the work in relatively undispersed masses. This may result in spots and other irregularities on the work which are undesirable and may even cause rejection of the workpiece. The present invention provides a shielding air stream which constantly flows rapidly over the electrode in an axial direction and prevents the accumulation of powder thereon to any troublesome extent. The electrode shielding air is taken preferably from the inlet air to the spray gun ahead of the trigger control regulator. The volume of air used in the electrode shielding is very low, amounting in a preferred design to only about 0.2 cfm.

BRIEF DESCRIPTION OF THE DRAWINGS

In the drawings,

FIGS. 1 and 2 when joined together along line A—A show a central vertical sectional view of a powder spray gun constructed in accordance with the present invention, the handle of the gun being broken away;

FIG. 3 is a sectional view taken on line 3—3 of FIG. 2;

FIG. 4 is a sectional view taken on line 4—4 of FIG. 2; and

DETAILED DESCRIPTION OF A PREFERRED EMBODIMENT

Figure 5:
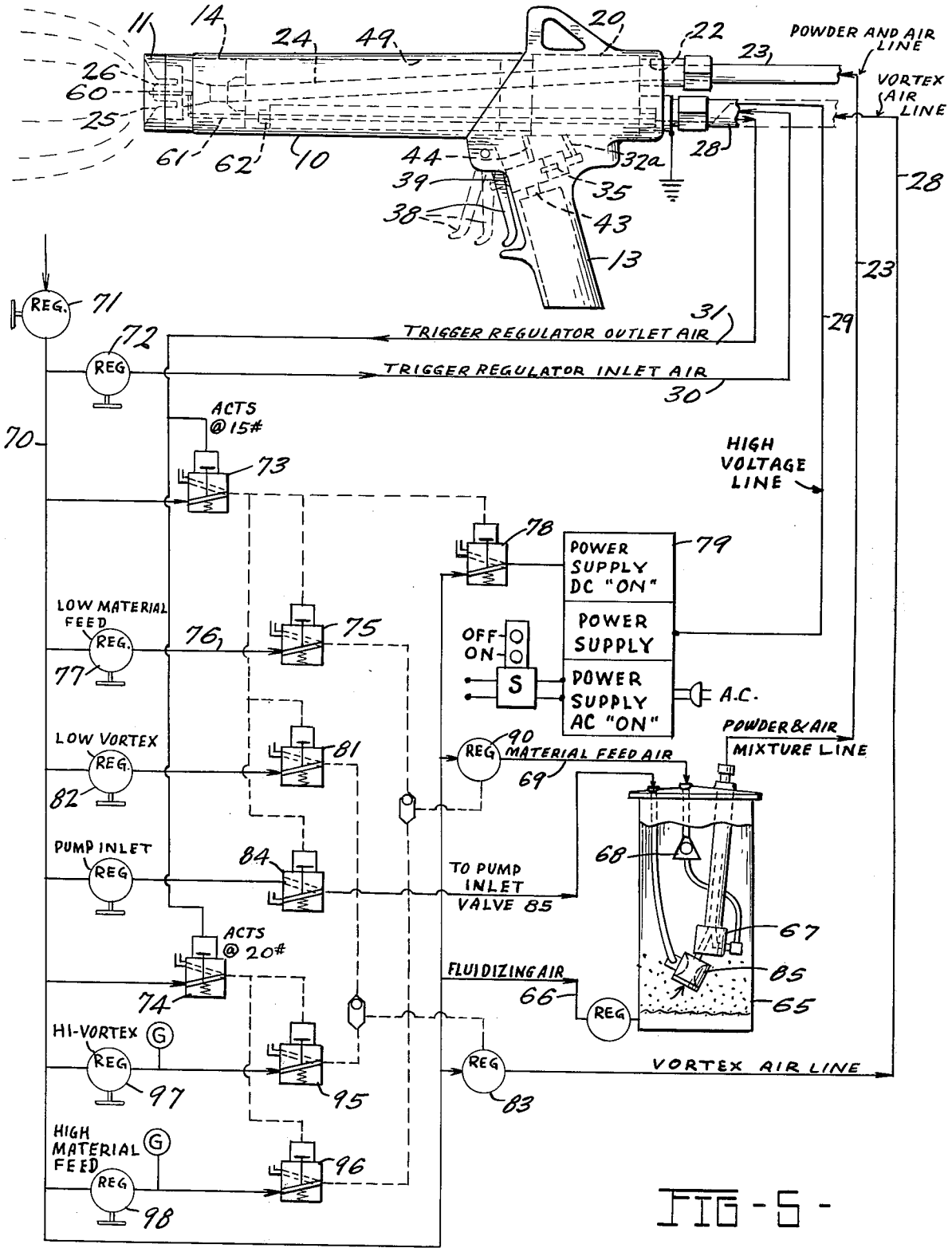
FIG. 5 is a control diagram for the spray gun, in accordance with the invention.

An electrostatic spray gun and control system therefor is shown in the drawings, and the barrel portion shown in FIGS. 1 and 2. These figures are to be considered as joined axially. The gun comprises a tubular barrel 10 made of an insulating material and carrying a spray cap 11 mounted in a front barrel portion 14 to which the barrel 10 is screwed on the outside and the spray cap 11 on the inside. As seen in FIG. 2, the barrel 10 is connected to a rear barrel portion 20 to which various conduits for electrical energy and air are connected and which is carried by a grounded metallic handle 13.

As indicated in FIG. 2 the rear barrel portion 20 has a first passage 22 therein to which a powder hose 23 is connected at the rear and a powder tube 24 is connected at the front. The tube 24 terminates at the front barrel portion 14 and its contents are discharged into a central powder passage 25 in the spray cap 11. This powder carrying air stream passes around a diffuser assembly indicated generally at 26 which is carried centrally of the powder passage 25 and which, in turn, carries a needle charging electrode as hereinafter described. The charging electrode is surrounded with an air washing passage which will also be described later.

At the rear of the gun handle portion 13 provision is also made for a connector element 27 in the rear barrel portion 20 to which an air tube 28 is connected, as well as the powder hose 23 as above described. Within the air tube 28 there is contained a high voltage charging cable 29, and a ground wire which has been omitted and the function of which is indicated merely by the conventional designation for grounding the handle 13. Within tube 28 there is also a small inlet air control line 30, and an outlet control line 31 as seen in FIG. 4. The tube 28 itself contains air at a suitable pressure for supplying the vortex passages of the gun as will be hereinafter described.

The inlet air line 30 connects radially to a gun passage 32 which carries air to supply the air washing passage and also connects to an annulus 33 formed as a groove in the rear barrel 20, from which annulus there is a radial passage **32*a* leading to the rear of a regulator valve 34 contained in the handle portion of the gun. The regulator itself is shown best in FIG. 2.**

The gun regulator 34 comprises a spring pressed ball valve 35 adapted to be moved away from its seat by a stem 36 carried by a spring pressed piston 37, the piston, in turn, being operated by a trigger 38 and an operating stem 39 connected to a cup 40 which is connected by a spring 41 to the piston 37. A small air relief passage 42 is drilled through the piston 37 and connects to an exhaust passage 43 so that there is a bleed flow of air through the regulator from the control air outlet line 44 when the valve 35 is on its seat. The air at regulated pressure, dependent on the pressure imposed by the trigger on the spring 41 then, appears beneath the valve 35 and at an internal passage 44 which connects to an annular passage 45 and, in turn, a radial passage 46. The radial passage 46 is drilled in the rear barrel portion 20 and connects to the control air outlet tube 31. The tube 31 carries control air at a pressure determined by the position of the trigger 38 and, hence, the force against the regulator ball valve 35. The pressure of the control air is at the command of the gun operator and is used to determine whether the gun operates at the first or second condition of operation hereinafter described.

The vortex air passage constitutes a drilled passage 47 (shown in dotted lines) leading from the interior of the tube 28 into an interior tubular passage 48 through the rear gun barrel 20. This passage communicates with the space 49 within the tubular barrel of the gun where it passes forwardly to the front barrel assembly.

The front barrel assembly 14, as shown in FIG. 1, receives the powder tube 24 and a tube **32*b* which connects to passage 32 leading from the air supply as hereinafter described to carry the air washing air supply. The spray cap 11 has disposed therein a series of vortex air passages which are designated 50. These passages enter the central powder gun discharge passage 25 tangentially thereof and cause the powder-carrying air stream to assume a whirling movement as is known in the art. The air for the vortex air passages is taken from the vortex air space 49 within the barrel by suitable connections 51–52 in the front barrel portion 14 and the spray cap 11.**

As stated above, the central diffuser assembly 26 is carried by a series of radial spokes 53 depending from the front barrel assembly 14. Electrode shielding air is taken from the main air inlet tube 30 via tube **32*b* and thence through a forwardly directed passage 54 in the front barrel portion 14 and then a radial passage 55 in one of the supporting spokes 53 of the diffuser assembly. The electrode air passage itself comprises a small forwardly directed air passage 56 in the center of the diffuser assembly 26.**

A charging electrode 60 comprises a needle element which is supported in the diffuser assembly 26 and which is connected by any suitable electrical connections 61 to a resistor 62 which is sealed within a tube 63 and which connects at its rear end to the high voltage cable 29 which extends through the rear barrel assembly 20 and is carried within the tube 28. The entire interior of the tube 63 is filled with an epoxy base dielectric gel to reduce any tendency of sparking and to seal the resistor in its housing. The high voltage wire or cable 29 returns to the control system hereinafter described.

The control system of the present invention comprises a plurality of parallel control circuits each of which is independently adjustable on a single control panel and each of which, thereafter, is selectively actuated from the spray gun regulator valve. Each circuit comprises a pilot operated air valve which is made responsive to a selected pressure at the will of the operator, and a number of function valves operated by each pilot valve. The function pilot valves control air flow from regulators adjusted by the operator and in the present embodiment are arranged to control vortex air and material feed. Once the operator has set up certain main regulators at the panel, further control is accomplished from the spray gun by depressing the trigger to impose a greater or lesser pressure on the pilot valves.

Referring now to FIG. 5, the various tubular connection are there shown as lines extending to and from the rear barrel portion 20 of the spray gun and are numbered as in FIG. 2. These tubes include the powder-air mixture tube 23, the trigger regulator air inlet line 30, the control air outlet line 31 which carries air away from the gun body at regulated pressure, and the vortex air tube 28. The high voltage wire 29 is also indicated.

The powder supply system comprises a tank 65 in which a body of powder is maintained in a fluidized condition by air passing into the tank from an air line 66 beneath a porous separator as is known in the art. Powder is discharged from tank 65 by an inductor 67 immersed in the fluidized powder mass as is also known in the art. An air line 69 supplies air to the inductor 67 at a suitable pressure from the central system hereinafter described.

The trigger outlet air line 31 connects to each of the paralleled pilot valves, two in the form shown, being numbered 73 and 74. Each pilot valve is normally closed, but opens in response to the appearance of an adjusted pressure at its operating end. The valves per se are conventional. In the diagram it is assumed that valve 73 operates at a lower pressure than the second pilot valve 74. For example, valve 73 may be preset to open at a pressure of from 15 psi. to 25 psi., while valve 74 may be preset to operate at a pressure of between 20 psi. and 40 psi. When the second pilot valve 74 operates the function valves 75 and 81 associated with the first pilot valve do not close, but are simply overriden.

The function valves that are controlled by the first pilot valve 73 comprise a low material feed valve 75 which controls a regulated air pressure from the main air line 70 by a connection 76, the regulator therefore being indicated at 77. Regulator 77 is adjustable, and its adjustment is made by the operator to determine the material feed required under the first spraying condition as hereinafter described. The valve 75 is normally closed, but is shown in the open position in FIG. 5. A second function valve that operates in response to opening valve 73 comprises a normally closed valve 78 which, when opened, passes air to a pneumatically operated switch (not shown) for the DC power supply 79, the output of which is connected to the high voltage cable 29.

A third function valve operated by pilot valve 73 comprises a "low vortex air flow" valve 81, which when opened, passes air from an adjustable low vortex air regulator 82 to a main vortex air regulator 83 and thence to the vortex air line 28. The main vortex air regulator 83 is a diaphragm regulator in which the air output pressure depends on the magnitude of the air pressure imposed on one side of the diaphragm, the output pressure appearing on the other. Adjustment of regulator 82 determines the level of flow of vortex air at the first spraying condition.

A fourth function valve operated by the pilot valve 73 comprises a material shut-off comprising a normally open valve 84 which, when opened, cuts off the flow of powder from the source by imposing a pressure on a pneumatically closed valve 85 within the powder tank 65 adjacent the upstream end of the powder channel of inductor 67. When valve 84 is closed, the air exhausts from valve 85 and the powder flow will thereafter take place at a rate determined by the operator by adjustment of a material feed air regulator valve 90. The regulator 90 is a pneumatically responsive valve which has its output pressure controlled to a level determined by the pressure on one side of its diaphragm as the case with the vortex air pressure regulator 83.

The second pilot valve 74 operates in response to a predetermined higher pressure in the control air outlet 31. There are two function valves (in the embodiment shown) that operate in response to an opening of the second pilot valve 74. These are, first, a high vortex air control valve 95, and a high material feed valve 96. Valve 95 controls the passage of air from an adjustable high vortex air regulator 97 to the main vortex air regulator 83. Valve 96 controls air from a high material feed regulator 98 which is also adjustable and which determines the pressure imposed on the diaphragm of regulator 90 when it is opened. Thus, regulator 90 passes air at a first pressure determined by regulator 77 (low material feed) or by pressure determined by regulator 98 (high material feed). Adjustment of regulators 77 and 98 are made at the control panel of the system. Similarly, the main vortex air regulator 83 passes air at a first pressure determined by regulator 82 (low vortex air flow) or at a second pressure determined by regulator 97 (high vortex air flow). Both regulators 82 and 97 are mounted on the control panel.

OPERATION

The operator first determines the nature of the part to be sprayed and decides whether it contains small areas that require low vortex air spraying conditions which will produce a narrow spray stream, and to what extend the part contains large flat surfaces that are best sprayed with a high vortex air flow which produces a larger spray pattern.

The operator then adjusts the low material feed regulator 77 and thus selects the quantity of material to be fed from the tank 65 to the tube 28. At the same time he makes an adjustment of regulator 82 to provide the vortex air flow required properly to produce the pattern at low material feed that the part requires. The first pilot valve 73 operates in response to the trigger regulator and determines when the low material and low vortex air flow function valves 75 and 81 are to be opened.

The operator next makes a selection of the high vortex air regulator 97 and a similar adjustment of high material feed regulator 98 to determine the spraying conditions that apply when the gun is being used to coat larger or flat surfaces. The second pilot valve 74 operates in response to further adjustments of the trigger and determines the onset of the high spraying conditions. As previously noted the first pilot valve 73 may be turned on at, for example, 15 psi. from the trigger regulator through line 31 and the second pilot valve 74 may be turned on at, for example, 25 psi. from line 31 and the trigger regulator 34.

During the first set of spraying conditions when the first pilot valve 73 is moved to its open position the air from the low material feed regulator 77 passes through line 76, function valve 75 into the regulator 90 where it appears on one side of the diaphragm of this regulator. Air from the main line 70 then passes into line 69 and into the inductor 67 at regulated pressure. At the same time air from the low vortex regulator 82 is passed by the second function valve 81 to appear at the diaphragm of the vortex air regulator 83 which then passes air at the lower selected pressure from the main line 70 to the vortex air line 28.

The third function valve 84 operated in response to pilot valve 73 actuates the material inlet valve 85 and permits fluidized powder to flow into the inductor 67.

The operator is then in a position to spray at the low vortex air conditions with a low material feed rate which he has adjusted. Thereafter, if the operator wishes to spray at a higher feed rate and with a higher vortex air flow the trigger 38 is depressed still farther toward the gun handle increasing the pressure in the trigger regulator outlet air line 31 which then acts on valve 74. The second pilot valve 74, as above noted, controls two function valves; namely, the high vortex air valve 95 which passes air from the adjusted regulator 97 to the diaphragm of the vortex air regulator 83 and, secondly, valve 96 is opened to pass air from the high material feed regulator 98 to the diaphragm of the material feed regulator 90. The flow of material is then increased and the vortex air flow is also increased so that the gun sprays a larger quantity of material over a wider pattern than previously existed.

Under either spraying condition the DC power supply is controlled by function valve 78. The AC power supply is turned on and off by a manual switch S.

Appropriate check valves are interposed in the system to prevent feedback from the function valves of one circuit to the other.

It will be noted that as soon as the system is turned on air appears in the trigger regulator inlet air line 30 and passes immediately through the passage 56 around the needle electrode so that the needle electrode 60 has a constant flow of shielding or washing air around it. This electrode than stays without any substantial accumulation of powder on it which would interfere with the excellence of the coating deposited by the gun.

What we claim is:

1. An electrostatic spray gun for the deposition of powdered coating material, said spray gun having a support means for an axial electrode, said electrode extending forwardly from said support means, a power supply to apply a charging voltage to said axial electrode to create an electrostatic field thereabout, means to discharge an air supported stream of powder coaxially with and around said electrode support means, means to supply an air stream to shape said powder stream to a desired configuration, and means to supply a flow of air axially through said support means in surrounding shielding relationship to said charging electrode, said air being caused to flow rapidly along the length of said electrode.

2. The combination of elements defined in claim 1 and means to start the flow of said air stream around the electrode prior to spraying.

3. The combination of elements defined in claim 1 in which said means to supply a flow of air around said electrode operates constantly whenever said electrode is charged.

4. In a control system for an electrostatic spray gun for the deposition of powdered coating material, said spray gun having an axial electrode, a power supply to apply a charging voltage to said axial electrode to create an electrostatic field thereabout, means to discharge an air supported stream of powder through said electrostatic field, and means to supply an air stream to shape said powder stream to a desired configuration, the improvement comprising:

an adjustable air regulator to control the quantity of powder delivered to said gun under one condition of operation;

a second adjustable air regulator to control the quantity of powder delivered to said gun under a second condition of operation;

a third adjustable air regulator to control the pressure of pattern shaping air delivered to said gun under a first condition;

a fourth adjustable air regulator to control the pressure of pattern shaping air delivered to said gun under said second condition of operation;

a first pilot valve to connect and cause the actuation of said first and third regulators in circuit with said gun;

a second pilot valve to connect and cause operation of said second and fourth regulators in circuit with said gun; and means carried by said gun and under the control of the operator to actuate said first and second pilot valves successively.

5. In a control system for an electrostatic spray gun for the deposition of powdered coating material, said spray gun having an axial electrode, a power supply to apply a charging voltage to said axial electrode to create an electrostatic field thereabout, means to discharge an air supported stream of powder through said electrostatic field, and means to supply an air stream to shape said powder stream to a desired configuration, the improvement comprising:

an adjustable air regulator to control the quantity of powder delivered to said gun under one condition of operation;

a second adjustable air regulator to control the quantity of powder delivered to said gun under a second condition of operation;

a third adjustable air regulator to control the pressure of pattern shaping air delivered to said gun under a first condition;

a fourth adjustable air regulator to control the pressure of pattern shaping air delivered to said gun under said second condition of operation;

a first pilot valve to connect and cause the actuation of said first and third regulators in circuit with said gun;

a second pilot valve to connect and cause operation of said second and fourth regulators in circuit with said gun;

means carried by said gun and under the control of the operator to actuate said first and second pilot valves successively; and means to supply a constant flow of air in surrounding shielding relationship to said charging electrode, said air being caused to flow rapidly along the length of said electrode.

* * * * *